US007214082B2

(12) United States Patent
Hashiguchi et al.

(10) Patent No.: US 7,214,082 B2
(45) Date of Patent: May 8, 2007

(54) CONNECTOR ALLOWING LOCKING OF CONNECTED STATE OR NON-CONNECTED STATE

(75) Inventors: Osamu Hashiguchi, Tokyo (JP); Kazuki Saito, Tokyo (JP); Toshiaki Ariyoshi, Tochigi (JP); Masahiko Sato, Tochigi (JP)

(73) Assignees: Japan Aviation Electronics Industry, Limited, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/549,092

(22) PCT Filed: Mar. 12, 2004

(86) PCT No.: PCT/JP2004/003277

§ 371 (c)(1),
(2), (4) Date: Sep. 13, 2005

(87) PCT Pub. No.: WO2004/082081

PCT Pub. Date: Sep. 23, 2004

(65) Prior Publication Data

US 2006/0178032 A1 Aug. 10, 2006

(30) Foreign Application Priority Data

Mar. 14, 2003 (JP) ..... 2003-069499

(51) Int. Cl.
*H01R 13/62* (2006.01)

(52) U.S. Cl. ..... 439/263; 439/342

(58) Field of Classification Search ..... 439/263, 439/264, 268, 342

See application file for complete search history.

(56) References Cited

U.S. PATENT DOCUMENTS

| | | | | |
|---|---|---|---|---|
| 4,836,798 | A * | 6/1989 | Carter | 439/268 |
| 5,342,213 | A * | 8/1994 | Kobayashi | 439/268 |
| 5,508,628 | A * | 4/1996 | Pfaff | 324/755 |
| 5,704,800 | A * | 1/1998 | Sato et al. | 439/342 |
| 5,727,959 | A * | 3/1998 | Yagi et al. | 439/157 |
| 6,419,514 | B1 * | 7/2002 | Yu | 439/342 |
| 6,666,691 | B2 * | 12/2003 | Ikeya | 439/71 |

(Continued)

FOREIGN PATENT DOCUMENTS

| | | |
|---|---|---|
| JP | 4-29512 | 7/1992 |

(Continued)

*Primary Examiner*—Neil Abrams
*Assistant Examiner*—Harshad C Patel
(74) *Attorney, Agent, or Firm*—Collard & Roe, P.C.

(57) ABSTRACT

A connector for switching between the states of the connection and non-connection to a mating connector by a cam mechanism (6) movably installed in insulators (2, 3), wherein the cam mechanism comprises a first cam (6*a*) and a second cam (6*b*). The first cam is rotatable about an axis, slidable between first and second positions in a direction parallel with the axis, and energized toward the first position by an elastic member (8). The second cam is rotated in conjunction with the first cam to provide either of the connected state and non-connected state according to a rotating angle. The first cam comprises a locked part (6*a*2) engaged with the lock part (3*b*3) of the insulator in the rotating direction thereof when positioned at the first position and disengaged from the lock part when positioned at the second position.

12 Claims, 7 Drawing Sheets

U.S. PATENT DOCUMENTS

| | | | | |
|---|---|---|---|---|
| 6,746,262 | B2 * | 6/2004 | He et al. | 439/342 |
| 6,890,201 | B2 * | 5/2005 | Hashiguchi et al. | 439/259 |

FOREIGN PATENT DOCUMENTS

| | | |
|---|---|---|
| JP | 10-288345 | 10/1998 |
| JP | 3073936 | 6/2000 |
| JP | 2000-286025 | 10/2000 |
| JP | 2000-306642 | 11/2000 |
| JP | 2004-47344 | 2/2004 |

* cited by examiner

CONNECTOR ALLOWING LOCKING OF CONNECTED STATE OR NON-CONNECTED STATE

CROSS REFERENCE TO RELATED APPLICATIONS

Applicants claim priority under 35 U.S.C. §119 of Japanese Application No. 2003-069499 filed on Mar. 14, 2003. Applicants also claim priority under 35 U.S.C. §365 of PCT/JP2004/003277 filed on Mar. 12, 2004. The international application under PCT article 21(2) was not published in English.

TECHNICAL FIELD

This invention relates to a connector that switches between a connected state and a non-connected state by operation of cams.

BACKGROUND ART

Connectors called ZIF (Zero Insertion Force) have been conventionally known. Connectors of this type are disclosed, for example, in Japanese Unexamined Patent Application Publication (JP-A) No. 2000-306642 and Japanese Unexamined Patent Application Publication (JP-A) No. 2000-286025. Those connectors each include a rotatable cam and a slider engaging the cam. By rotational operation of the cam, the slider is forced to slide so that switching is performed between a connected state and a non-connected state with respect to a mating connector. This enables connection or disconnection of the connector with an extremely small operating force.

However, when the connector is subjected to shock, vibration, or the like in the connected state, it is expected that the cam may be rotated due to its influence. When the cam is rotated, there is a possibility that the slider may slide to cause switching from the connected state to the non-connected state. Conversely, switching may be caused from the non-connected state to the connected state. In any event, there is a problem that the connected state or the non-connected state of the connector cannot be reliably maintained.

DISCLOSURE OF THE INVENTION

It is therefore an object of this invention to provide a connector that can reliably maintain a connected state or a non-connected state even when subjected to shock, vibration, or the like.

It is another object of this invention to realize the foregoing object by a mechanism that is easy to operate.

It is still another object of this invention to realize the foregoing object without complicating a structure.

According to an aspect of the present invention, there is provided a connector including an insulator and a cam mechanism movably mounted to said insulator for switching between a connected state and a non-connected state with respect to a mating connector, said connector characterized in that said cam mechanism comprises a first cam that is movable about one axis and slidable between a first and a second position in a predetermined direction parallel to said one axis, a second cam that is rotated in conjunction with said first cam to provide either one of said connected state and said non-connected state in response to a rotation angle thereof, and an elastic member biasing said first cam toward said first position, said insulator includes a locking portion, and said first cam comprises a to-be-locked portion that is engaged with said locking portion in a rotational direction thereof when located at said first position while disengaged from said locking portion when located at said second position.

BEST MODE FOR CARRYING OUT THE INVENTION

Referring to FIGS. 1 to 7, description will be made about a connector according to an embodiment of this invention.

Figure 1:
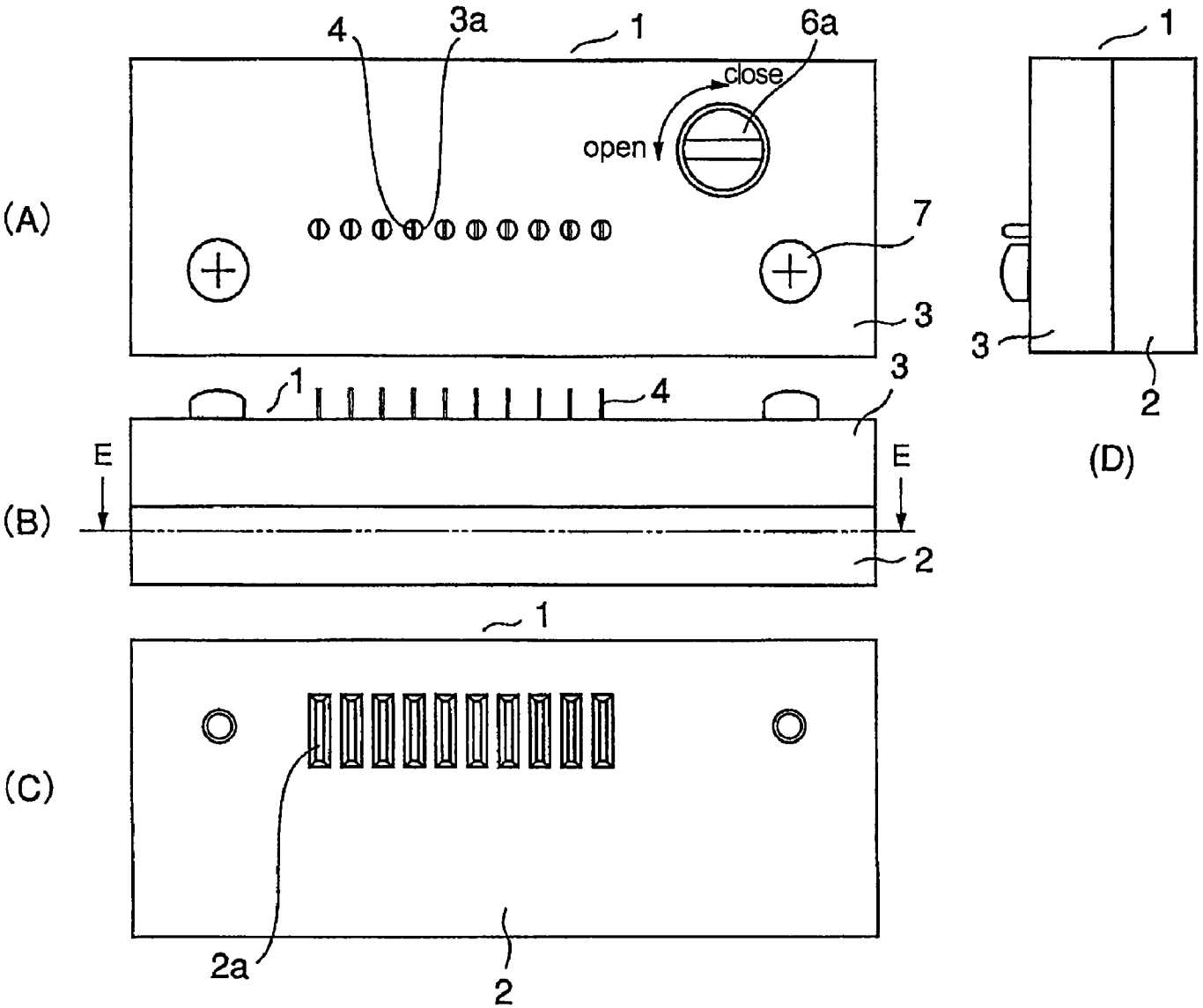
FIG. 1 shows a locking mechanism of a socket connector of one embodiment of this invention, wherein (A) is a rear view, (B) is a plan view, (C) is a front view, and (D) is a side view.
Figure 4:
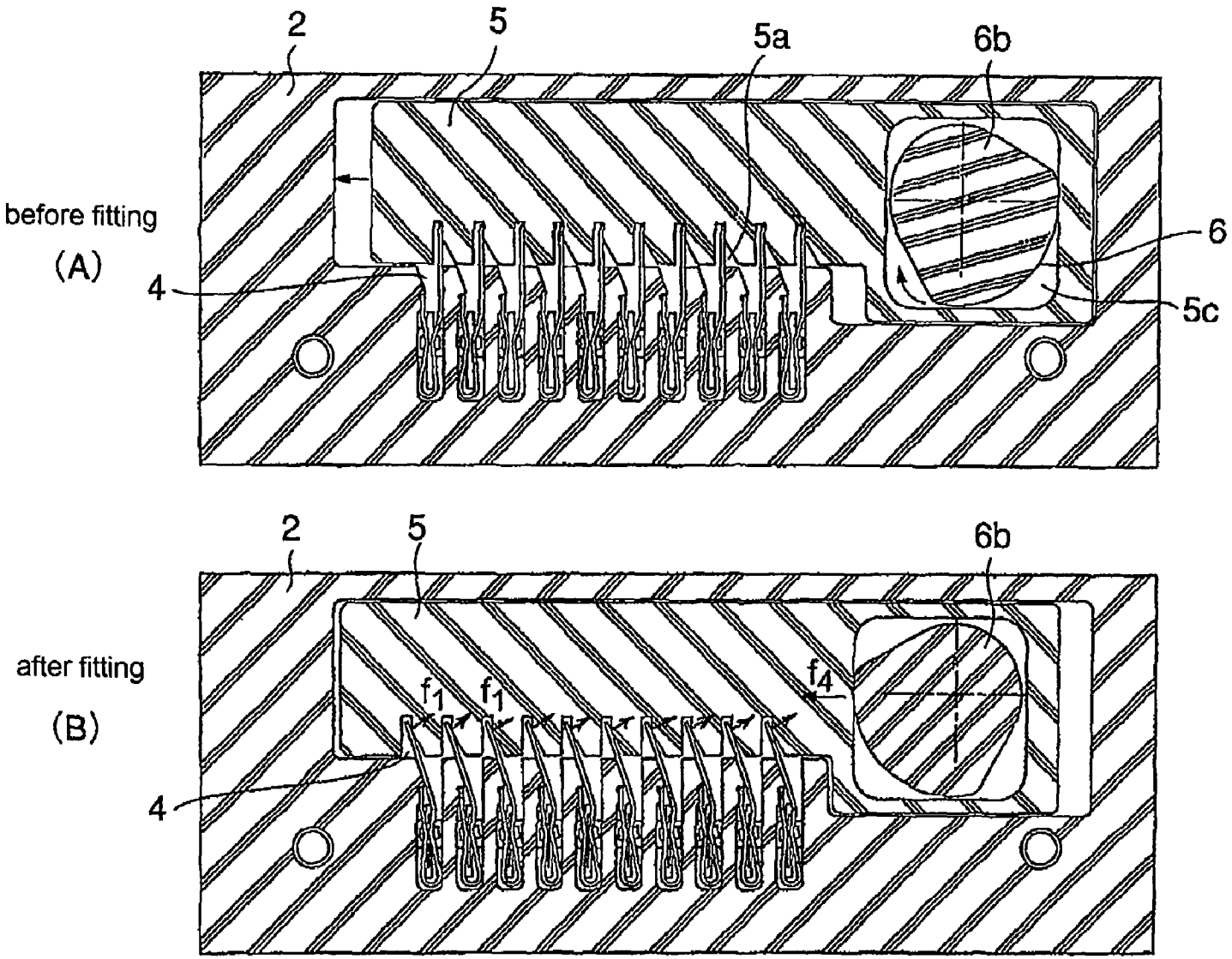
FIG. 4 is sectional views each taken along line E—E in FIG. 1, (B), wherein (A) shows a non-connected state before fitting of the pin connector and (B) shows a connected state after fitting of the pin connector.
Figure 6:
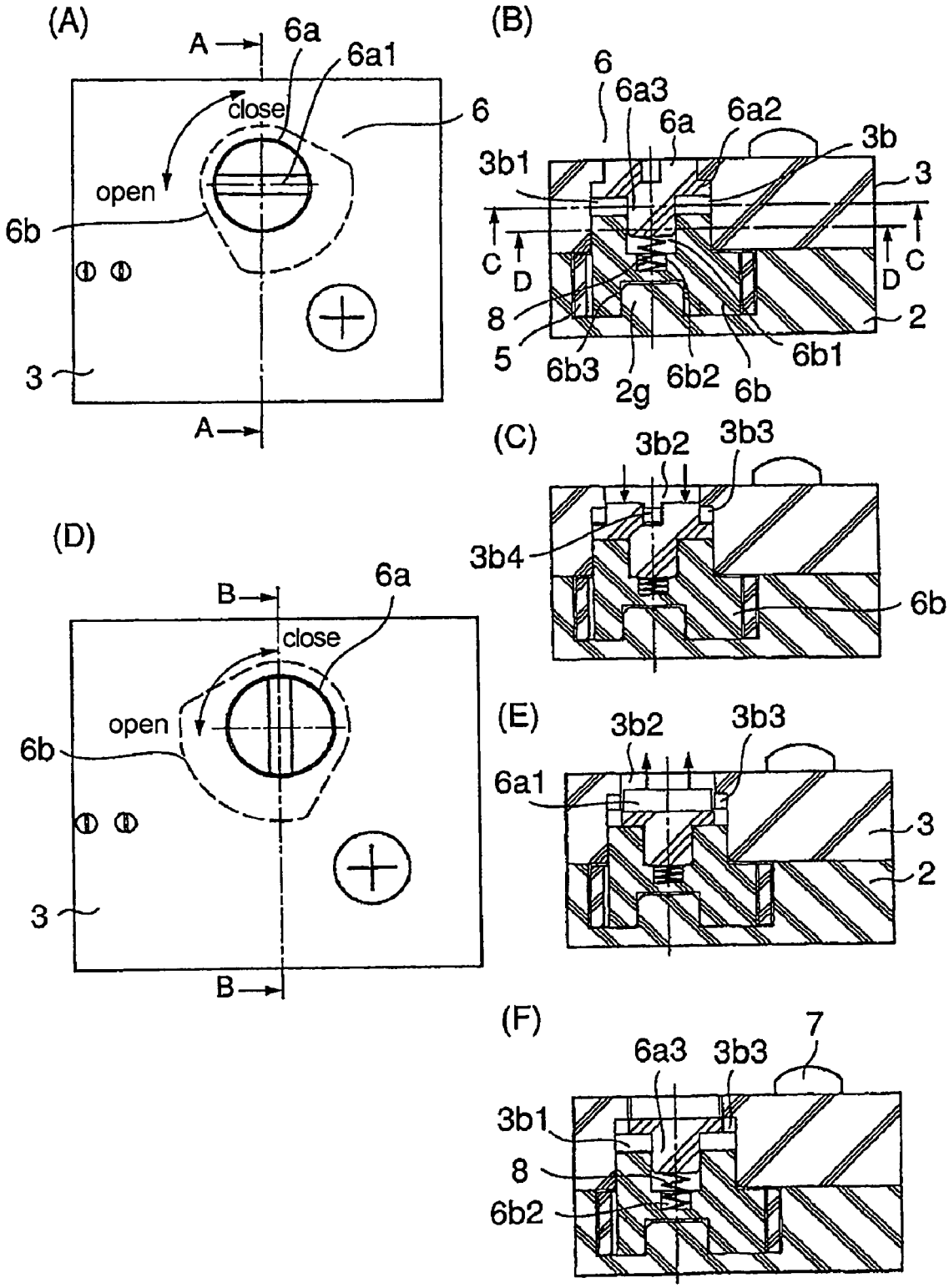
FIG. 6 shows the locking mechanism of the socket connector, wherein (A) is a plan view of the non-connected state (open position), (B) is a sectional view taken along line A—A in (A), (C) is a sectional view of the state where an upper cam is pushed into a cover in (B), (D) is a plan view of the connected state (closed position), (E) is a sectional view taken along line B—B in (D), and (F) is a sectional view of the state where the upper cam is restored in (E).

In FIGS. 1, 4, and 6, a connector 1 is a socket connector which is generally called a ZIF connector. The socket connector 1 comprises an insulating case 2, an insulating cover 3 covering the case 2, and conductive socket contacts 4 retained by the cover 3. The case 2 and the cover 3 are fixed together by a pair of screws 7. The socket contacts 4 have tip portions that are respectively exposed through a plurality of projection holes 3*a* provided in the cover 3. The case 2 is provided with a plurality of insertion holes 2*a* for inserting a plurality of pin contacts of a pin connector. Herein, the case 2 and the cover 3 are collectively called an insulator.

An insulating actuator 5 is slidably mounted in the case 2. The actuator 5 is caused to slide by operation of a cam mechanism 6. The cam mechanism 6 comprises a first cam, i.e. an upper cam 6*a*, that is rotatable and insulative and a second cam, i.e. a lower cam 6*b*, that is insulative and moves in conjunction with the upper cam 6*a*. A cylindrical compression coil spring 8 is interposed between the upper cam 6*a* and the lower cam 6*b* as an elastic member. The upper cam 6*a* is rotatable about one axis and slidable between first and second positions in a predetermined direction parallel to such one axis. As will be described later, the lower cam 6*b* is engaged with the upper cam 6*a* so as to be rotated in conjunction with the upper cam 6*a*.

Figure 2:
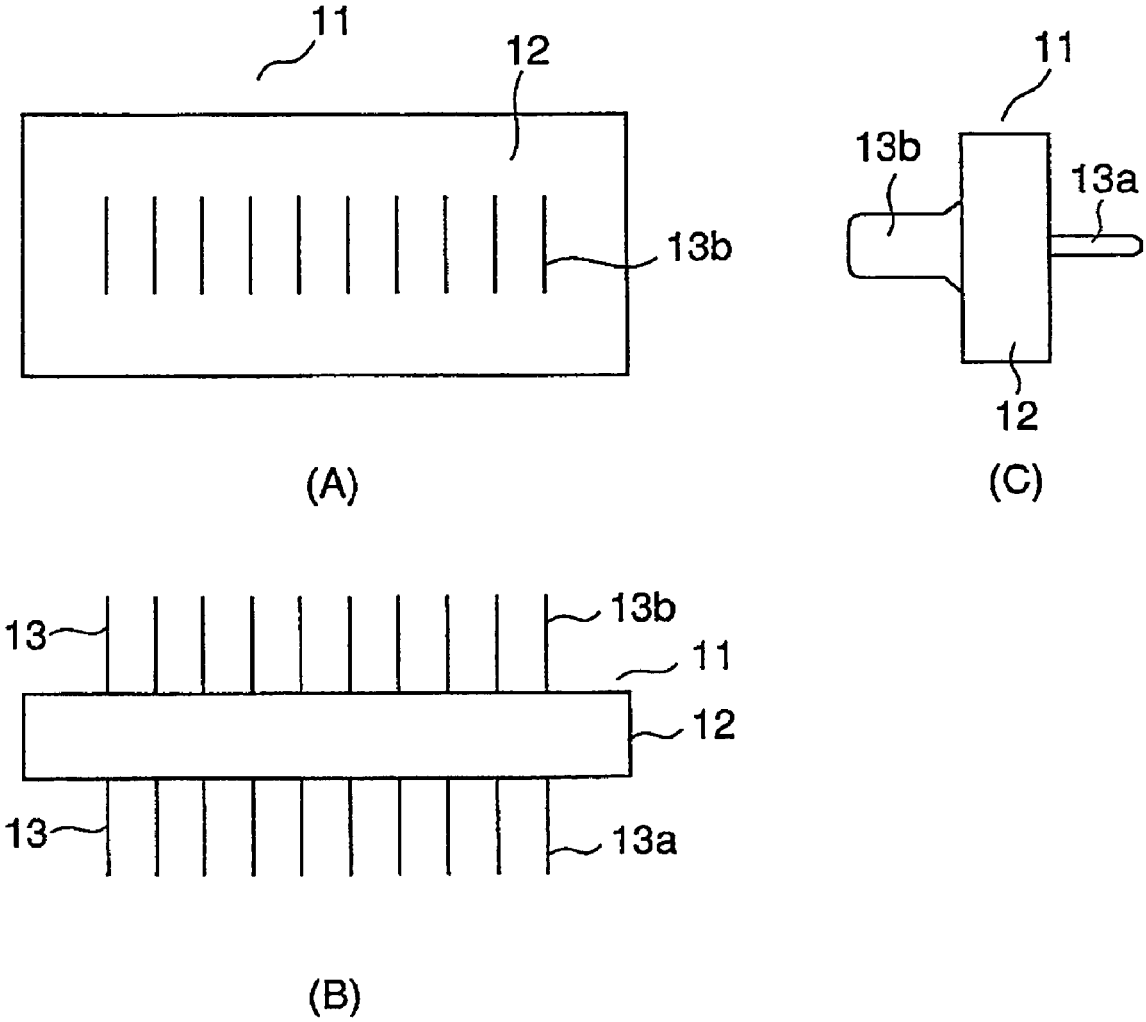
FIG. 2 shows a pin connector for connection to the socket connector, wherein (A) is a front view, (B) is a plan view, and (C) is a side view.

FIG. 2 shows a pin connector 11 as a mating connector to be connected to the socket connector 1. The pin connector 11 comprises an insulator 12 and a plurality of pin contacts 13 retained by the insulator 12. Each pin contact 13 has a pin-shaped terminal 13*a* projecting from one side of the insulator 12 for connection to a printed board and a thin plate-shaped pin 13*b* projecting from the other side of the insulator 12 for connection to the socket contact 4.

Figure 3:
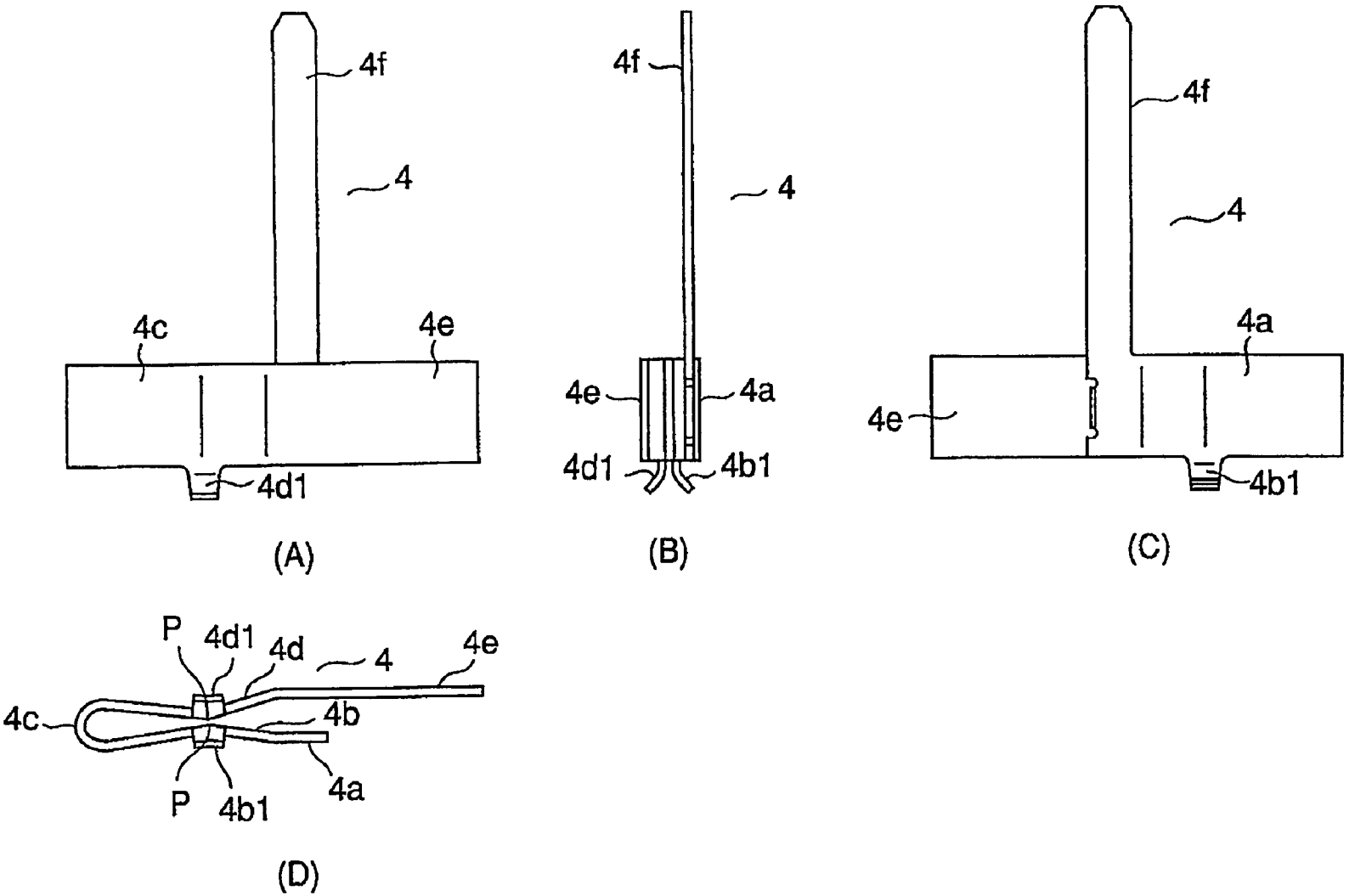
FIG. 3 shows a contact of the socket connector, wherein (A) is a front view, (B) is a side view, (C) is a rear view, and (D) is a bottom view.
Figure 5:
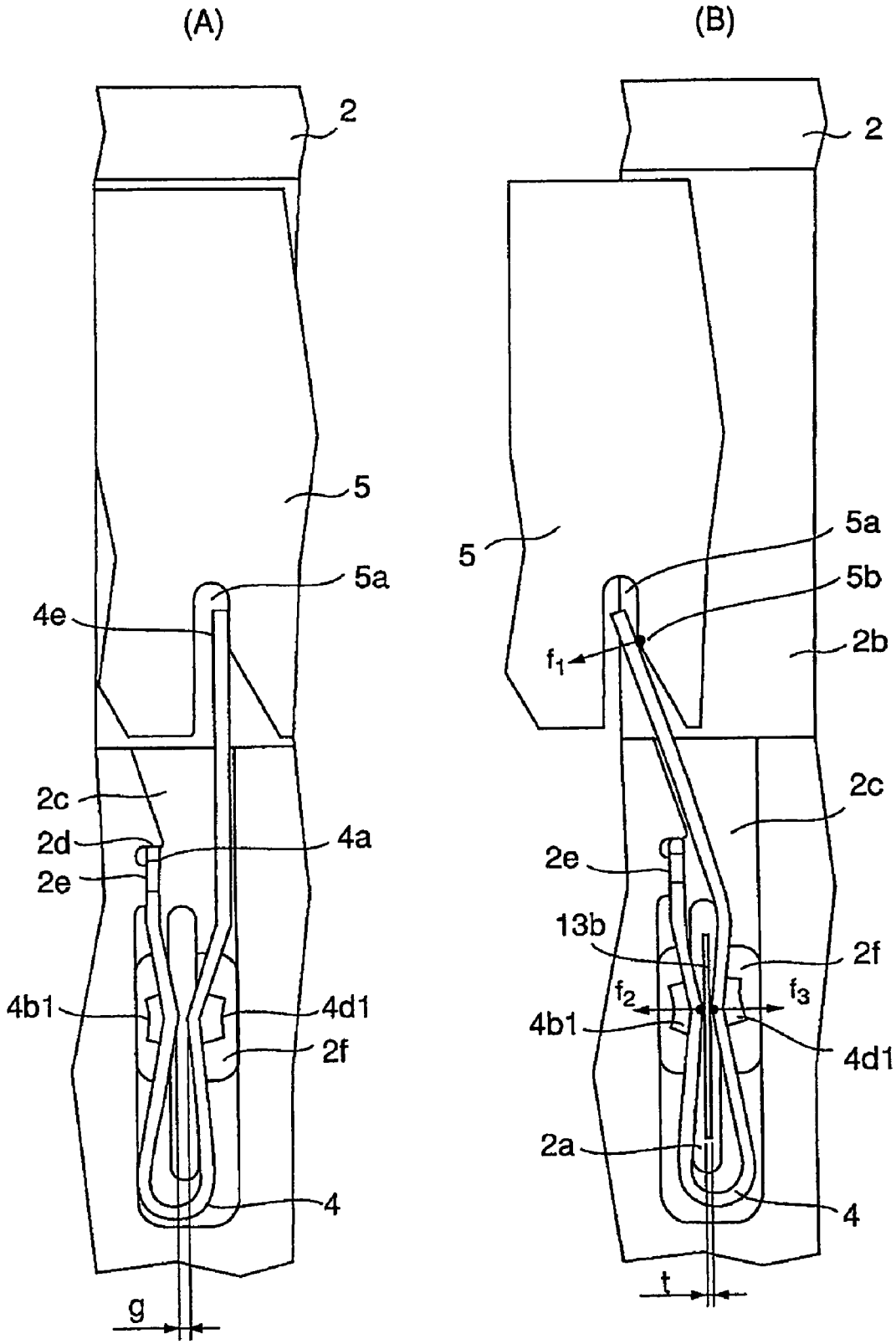
FIG. 5 is enlarged sectional views of the main part before and after the socket connector and the pin connector are fitted together, wherein (A) shows the state before the fitting and before sliding of an actuator and (B) shows the state after the fitting and after sliding of the actuator.

In FIGS. 3 and 5, each socket contact 4 is formed integral and continuous so as to have a stationary portion 4*a* to be fixed to the case 2, a bent portion 4*b* bent at a first contact point P, a generally U-shaped portion 4*c*, a bent portion 4*d* bent at a second contact point P, a movable portion 4*e* to be pushed by the actuator 5, and a terminal portion 4*f* projecting from the stationary portion 4*a*. The first contact point P and the second contact point P face each other so as to provide a gap therebetween. On the outer sides of the first contact P and the second contact point P, guides 4*b*1 and 4*d*1 are symmetrically provided, respectively. The guides 4*b*1 and 4*d*1 serve to introduce the pin 13*b* of the corresponding pin contact 13 into the gap between the contact points P so that the pin 13*b* contacts the contact points P with no insertion force without buckling that is generated due to interference of the pin 13*b* with the corresponding socket contact 4.

When the lower cam 6*b* rotates in an arrow direction in FIG. 4, (A), the actuator 5 slides in an arrow direction to a position shown in FIG. 4, (B). In this event, the actuator 5 displaces the movable portions 4*e* of the socket contacts 4. That is, the actuator 5 slides following the rotation of the lower cam 6*b* to drive the socket contacts 4, thereby performing switching between a connected state and a non-connected state of the socket connector 1 and the pin connector 11. Therefore, as will be clear from later description, the contact points P implement a ZIF function of sandwiching under pressure the pin 13*b* of each pin contact 13.

In FIG. 5, (A), a great part of each socket contact 4 is received in a contact groove 2*c*. A forward end and a side surface of the stationary portion 4*a* are in abutment with a stopper 2*d* and a fixing wall 2*e* of the case 2, respectively. The movable portion 4*e* is received in a driving groove 5*a* of the actuator 5. The guides 4*b*1 and 4*d*1 are received in a guide groove 2*f* of the case 2. Herein, the gap g between the contact points P is designed to be greater than a thickness t of the pin 13*b*.

In the case where the pin connector 11 is connected to the socket connector 1, when the actuator 5 slides from a position in FIG. 5, (A) to a position in FIG. 5, (B), the upper cam 6*a* and the lower cam 6*b* rotate to the right in conjunction therewith (see FIG. 1, (A) and FIG. 4, (A)). Since the movable portion 4*e* of each socket contact 4 receives a force $f_1$ from a corner 5*b* of an inclined surface of the driving groove 5*a* of the actuator 5, the socket contact 4 is elastically deformed. In this event, the side surface of the stationary portion 4*a* receives a reaction force from the fixing wall 2*e* of the case 2 and therefore the contact points P receive forces $f_2$ and $f_3$ from both surfaces of the pin 13*b* of the pin connector 11 while sandwiching it therebetween under pressure.

Figure 7:
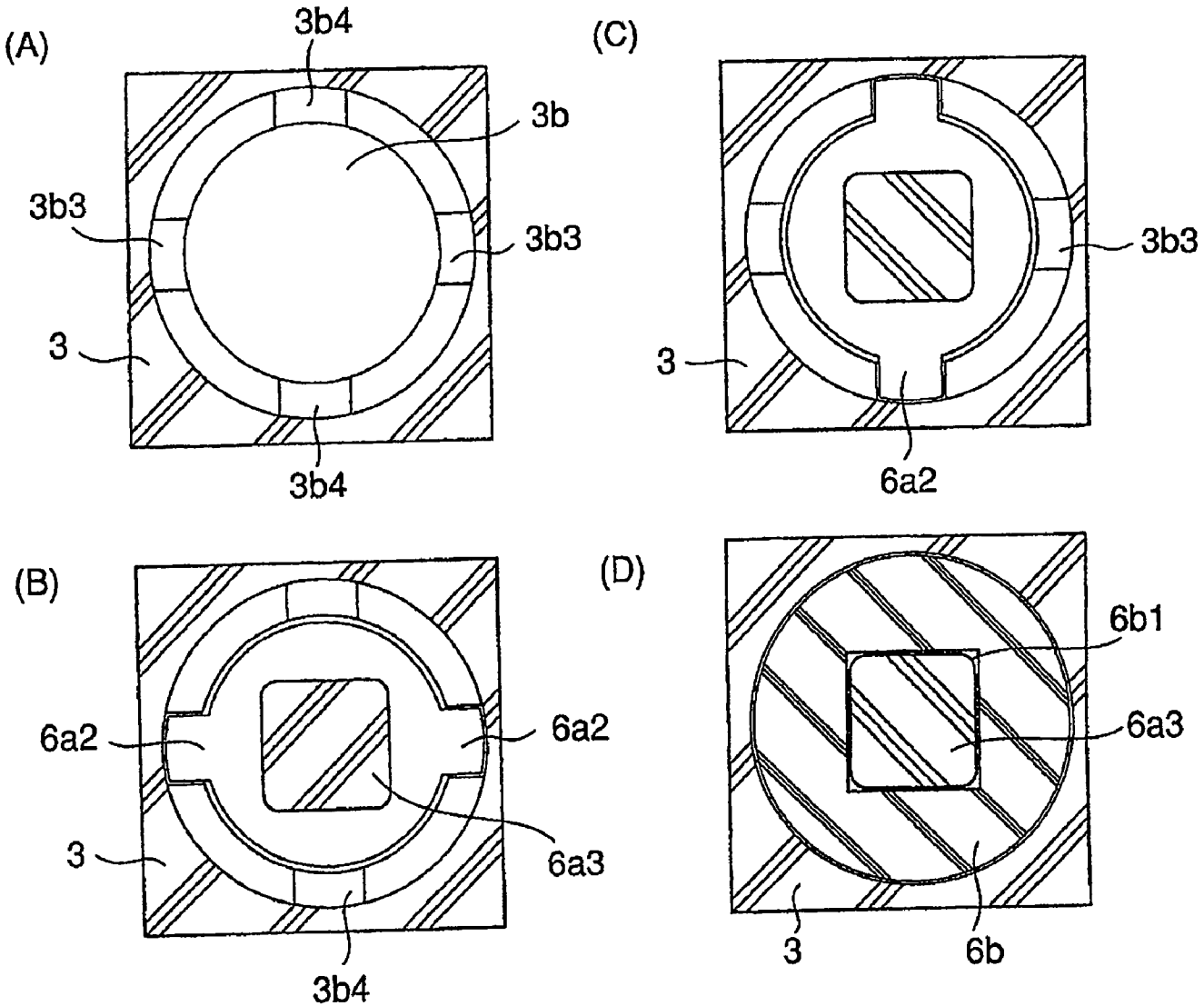
FIG. 7 is enlarged sectional views each taken along line C—C or line D—D in FIG. 6, (B), wherein (A) shows the state taken along line C—C (but, the upper cam not illustrated), (B) shows the non-connected state taken along line C—C, (C) shows the connected state taken along line C—C, and (D) shows the state taken along line D—D.

The socket connector 1 has a locking mechanism capable of locking the operation of the cam mechanism 6. Referring to FIGS. 6 and 7, the locking mechanism will be described.

As shown in FIG. 6, (A) and (B), the upper cam 6*a* basically has a circular shape in cross-section. In the upper part of a circular cam insertion hole 3*b* provided in the cover 3, the upper cam 6*a* is mounted so as to be rotatable by 90° between an open position and a closed position. The upper cam 6*a* has a linear groove, i.e. a minus groove 6*a*1, at one end in the foregoing predetermined direction, i.e. on the surface operable from the exterior, a pair of to-be-locked bosses 6*a*2 at peripheral symmetrical positions, and an angular boss 6*a*3 at the other end in the predetermined direction, i.e. on the back side. The minus groove 6*a*1 enables rotational operation of the upper cam 6*a* by the use of a so-called minus driver. The to-be-locked bosses 6*a*2 project radially outward and are collectively called a to-be-locked portion herein. The angular boss 6*a*3 has a square shape in cross-section.

The lower cam 6*b* is disposed so as to face the upper cam 6*a* in the predetermined direction and retained by the case 2 and the cover 3 so as to be rotatable by 90° about the foregoing one axis. The lower cam 6*b* has an angular hole 6*b*1 on an upper surface thereof, a spring receiving hole 6*b*2 continuous with the angular hole 6*b*1, and a rotation center hole 6*b*3 on a lower surface thereof.

The angular boss 6*a*3 of the upper cam 6*a* is fitted into the angular hole 6*b*1 of the lower cam 6*b* so as to be slidable in the foregoing predetermined direction. Naturally, because of the fitting between the angular boss 6*a*3 and the angular hole 6*b*1, the upper cam 6*a* and the lower cam 6*b* are engaged with each other in the rotational direction so as to rotate in conjunction with each other.

In order to allow vertical movement of the upper cam 6*a*, the cam insertion hole 3*b* of the cover 3 is provided with clearances 3*b*1 and 3*b*2. Further, as shown in FIG. 7, (A), the cam insertion hole 3*b* is provided with a pair of locking boss grooves 3*b*3 for engagement with the pair of to-be-locked bosses 6*a*2 of the upper cam 6*a* at the open position (before fitting) and a pair of locking boss grooves 3*b*4 for engagement therewith at the closed position (after fitting). The pair of to-be-locked bosses 6*a*2 differ in phase by 180° while the two pairs of locking boss grooves 3*b*3 and 3*b*4 differ in phase by 90°. These locking boss grooves 3*b*3 and 3*b*4 extend in radial directions and are collectively called a locking portion herein.

The case 2 is provided with an actuator insertion hole 2*b* (see FIG. 5, (B)) for allowing the actuator 5 to slide. The actuator 5 is provided with a lower-cam insertion hole 5*c* (see FIG. 4, (A)) for allowing the lower cam 6*b* to rotate. Further, the case 2 is provided with a support shaft 2*g* for receiving the rotation center hole 6*b*3 of the lower cam 6*b* fitted therearound.

Now, description will be made about the operation of the locking mechanism.

In FIG. 6, (A) and (B) and FIG. 7, (B), the pair of to-be-locked bosses 6*a*2 are inserted in the pair of locking boss grooves 3*b*3 of the cover 3. In this state, the upper cam 6*a* is stopped from rotation so as to be locked. In this event, the socket connector 1 and the pin connector 11 are in the non-connected state. Since the upper cam 6*a* is locked, the non-connected state is reliably maintained.

For switching from the non-connected state to the connected state, the minus driver (not illustrated) is first inserted into the minus groove 6*a*1 of the upper cam 6*a* and pushes the upper cam 6*a* to the inside of the cam insertion hole 3*b* of the cover 3. Then, the upper cam 6*a* causes compression of the compression coil spring 8 to reach the state of FIG. 6, (C). Therefore, the pair of to-be-locked bosses 6*a*2 are released from the locking engagement with the pair of locking boss grooves 3*b*3 of the cover 3. In other words, the to-be-locked bosses 6*a*2 escape from the locking boss grooves 3*b*3.

Then, when the upper cam 6*a* is rotated to the right by 90°, the upper cam 6*a* reaches the state of FIG. 6, (D) and (E) and FIG. 7, (C). In this event, since the angular boss 6*a*3 of the upper cam 6*a* and the angular hole 6*b*1 of the lower cam 6*b* are fitted together as shown in FIG. 7, (D), the lower cam 6*b* is also rotated to the right by 90°. Therefore, as shown in FIG. 4, (A), the lower cam 6*b* causes the actuator 5 to slide in the arrow direction to thereby achieve the state shown in FIG. 4, (B) so that the socket connector 1 and the pin connector 11 are placed in the connected state. In this connected state, the lower cam 6*b* exerts an action of a force $f_4$ to the actuator 5 while the actuator 5 receives a reaction of the force $f_1$ from each socket contact 4.

Subsequently, when the minus driver is removed from the minus groove 6*a*1 of the upper cam 6*a*, the upper cam 6*a* reaches the state shown in FIG. 6, (F) due to a restoring force of the compression coil spring 8. In this event, the pair of to-be-locked bosses 6*a*2 enter the pair of locking boss grooves 3*b*4 of the cover 3. Therefore, the upper cam 6*a* is stopped from rotation so as to be locked and, as a result, the connected state is reliably maintained.

Although the case 2 and the cover 3 are in the form of the separate components in this embodiment, it is possible to change the design so that they are formed as a single component.

The invention claimed is:

1. A connector including an insulator and a cam mechanism movably mounted to said insulator for switching between a connected state and a non-connected state with respect to a mating connector, wherein said cam mechanism comprises a first cam that is rotatable about an axis and movable between a first and a second position in a predetermined direction parallel to said axis, a second cam that is rotated in conjunction with said first cam without movement in said predetermined direction to provide either one of said connected state and said non-connected state in response to a rotation angle thereof, and an elastic member biasing said first cam toward said first position, said insulator includes a locking portion, and said first cam comprises a to-be-locked portion that is engaged with said locking portion in a rotational direction thereof when said first cam is located at said first position while disengaged from said locking portion when said first cam is located at said second position.

2. The connector according to claim 1, wherein said locking portion comprises two pairs of locking boss grooves spaced apart by 90° and said to-be-locked portion comprises a pair of to-be-locked bosses spaced apart by 180° and selectively fitted into either one of said two pairs of locking boss grooves.

3. The connector according to claim 1, wherein said first cam comprises an angular boss extending in said predetermined direction along said one axis and said second cam comprises an angular hole that is rotatable about said one axis and fitted around said angular boss so as to be engaged with said angular boss in a rotational direction thereof.

4. The connector according to claim 3, wherein said elastic member comprises a compression coil spring disposed in said angular hole.

5. The connector according to claim 4, wherein said second cam has a spring receiving hole at the bottom of said angular hole and said compression coil spring has one end disposed in said spring receiving hole and the other end contacting said angular boss.

6. The connector according to claim 5, wherein said spring receiving hole has a circular shape in section.

7. The connector according to claim 1, wherein said first cam has a surface at one end in said predetermined direction, said surface being exposed outside of said insulator and operable from the exterior of said insulator.

8. The connector according to claim 7, wherein said surface has a linear groove.

9. The connector according to claim 1, further comprising conductive contacts retained by said insulator, wherein said connected state is obtained when said contacts are brought into contact with said mating connector while said non-connected state is obtained when said contacts are separated from said mating connector.

10. The connector according to claim 9, further comprising an actuator slidably retained by said insulator and engaged with said second cam and said contacts, wherein said actuator slides to drive said contacts following rotation of said second cam, thereby switching between said connected state and said non-connected state.

11. The connector according to claim 10, wherein said first cam comprises an angular boss extending in said predetermined direction along said one axis and said second cam comprises an angular hole that is rotatable about said one axis and fitted around said angular boss so as to be engaged with said angular boss in a rotational direction thereof.

12. The connector according to claim 1, wherein said locking portion has two locking positions which are angularly spaced around said one axis and correspond to said connected and said non-connected states, respectively, and said to-be-locked portion is engaged at either one of said locking positions with said locking portion in a rotational direction thereof when said first cam is located at said first position.

* * * * *